United States Patent [19]

Jameson et al.

[11] 4,120,822

[45] Oct. 17, 1978

[54] CATALYTICALLY ACTIVE COMPOSITION FOR ELECTROLESS PLATING

[75] Inventors: Melvin Neil Jameson, St. Marys; James Donald Klicker, Morgantown; Gerald Albert Krulik, Washington; James Farnsworth York, Morgantown, all of W. Va.

[73] Assignee: McGean Chemical Co., Cleveland, Ohio

[21] Appl. No.: 795,836

[22] Filed: May 11, 1977

Related U.S. Application Data

[63] Continuation of Ser. No. 652,002, Jan. 26, 1976, abandoned.

[51] Int. Cl.[2] ..... B01J 27/06; C23C 3/00

[52] U.S. Cl. ..... 252/441; 106/1.11

[58] Field of Search ..... 252/441; 106/1

[56] References Cited

U.S. PATENT DOCUMENTS

| | | | |
|---|---|---|---|
| 3,285,754 | 11/1966 | Hopkin | 106/1 X |
| 3,532,518 | 10/1970 | Ottavio | 106/1 |
| 3,565,823 | 2/1971 | Parshall | 252/431 N X |
| 3,632,388 | 1/1972 | Greenwald | 106/1 X |
| 3,674,675 | 7/1972 | Leaman | 106/1 X |
| 3,698,919 | 10/1972 | Kuzmik | 106/1 |
| 3,790,400 | 2/1974 | Kuzmik | 106/1 X |
| 3,884,704 | 5/1975 | Rantell et al. | 106/1 |
| 3,904,792 | 9/1975 | Gulla et al. | 106/1 X |

*Primary Examiner*—Delbert E. Gantz
*Assistant Examiner*—William G. Wright
*Attorney, Agent, or Firm*—Fay & Sharpe

[57] ABSTRACT

A catalytically active composition for use in electroless plating, which is prepared without the use of acid by reacting an aqueous halide solution (chloride or bromide) of a palladium salt with a compatible tin salt. The tin salt can be molten or in the form of an aqueous solution containing water in an amount which is insufficient to cause precipitation of the tin. The final concentrated product may be used to prepare working bath solutions for electroless plating by dilution with an appropriate acid solution; but the concentrate itself contains essentially no free acid and may be either a liquid or a solid material, depending on process conditions.

6 Claims, No Drawings

CATALYTICALLY ACTIVE COMPOSITION FOR ELECTROLESS PLATING

This is a continuation, of application Ser. No. 652,002 filed Jan. 26, 1976, now abandoned.

CROSS-REFERENCE TO RELATED APPLICATIONS

This invention is generally related to subject matter described in copending applications: Ser. No. 574,498 filed on May 5, 1975 by Jameson et al; Ser. No. 591,363 filed on June 30, 1975 by Jameson et al, and Ser. No. 622,789 filed on Oct. 15, 1975 by Jameson et al. All of the above copending applications are directed to acid-free catalyst concentrates, methods of their manufacture and their use in electroless plating processes. All are assigned to the same assignee as the present invention.

BACKGROUND OF THE INVENTION

1. Field of the Invention

Catalytically active compositions for use in plating metal on a nonconductive substrate by electroless deposition.

2. Description of the Prior ARt

U.S. Pat. No. 3,011,920 (Shipley) describes a process in which a colloidal solution is prepared by mixing an aqueous acid solution of palladium chloride with an aqueous acid solution of stannous chloride and optionally including a tin salt such as sodium stannate. This is purported to produce a lyophilic colloid which, after acceleration with an acid or alkaline solution such as hydrochloric acid or sodium hydroxide provides a sensitizing layer for the subsequent electroless plating of a metal such as copper.

U.S. Pat. No. 3,672,923 (Zeblisky) describes solid compositions dilutable to optically clear sensitizing solutions for electroless plating. These solutions are prepared by combining a dilute solution of a noble metal salt in hydrochloric acid with a hydrochloric acid solution of a stannous salt such as stannous chloride dihydrate. The mixture is heated and then subsequently cooled and evaporated to dryness under vacuum to constant weight. The solid composition, as described, may then be reconstituted in hydrochloric acid to provide an active sensitizing solution.

Nathan Feldstein, "Reliability in Printed Circuitry Metalization — A case for Improved Catalyzing Systems", *Plating,* June 1973. In the Feldstein article it is recognized that the inclusion of halide salts improves the stability of catalytic sensitizer solutions.

U.S. Pat. No. 3,904,792, Gulla et al, issued Sept. 9, 1975. This patent discloses the advantages of using excess halide ions, in concentrations of at least 0.2 moles/-liter in excess of the other chloride ion components, such as furnished by stannous and palladium chloride solutions.

SUMMARY OF THE INVENTION

The present invention relates to catalytically active compositions for rendering the surface of a non-conductive substrate receptive to an electroless plating solution to form a uniformly adherent layer of metal. This layer, sometimes referred to as the preplate, may then be electrolytically plated in any conventional manner. It is well understood in the art that the sensitizing step, described above, is preceeded by a surface treatment which renders the substrate surface capable of forming a tight bond. This is normally done by etching in a strong oxidizing acid solution such as chromic acid, or a mixture of chromic and sulfuric acids.

As described above in connection with the discussion of the prior art, the solutions heretofore recognized as being effective for catalytic sensitization of the surface are so-called palladium-tin systems in which a palladium salt, such as palladium chloride, and a tin salt such as stannous chloride, are prepared by carefully mixing solutions (in aqueous hydrochloric acid) to form a solution which may or may not be colloidal in nature. It should be noted that whereas the Shipley patent purports to describe a colloidal system, the Zeblisky patent describes optically clear solutions which are stated to be noncolloidal in nature. In any event, the solutions in both cases are prepared by a reaction in aqueous acid solution to form the sensitizing composition whether it be a colloid or a complex. Some problems may be experienced in preparing the Zeblisky dry catalyst compositions because of the difficulty in removing all excess water and hydrochloric acid. It is necessary to evaporate the solution to dryness to produce the solid compositions therein described, and the catalytic activity and stability can be seriously affected if water and/or acid remains after evaporation.

It would, of course, be desirable to provide compositions in solid form because of their ease in handling. This is especially true when considering the difficulty of replenishing an existing working bath. If the replenisher solution is added in relatively dilute liquid form, it is normal practice to remove an equivalent volume of the exhausted bath to make room for the addition. If the materials can be added in the highly concentrated solid form, it is only necessary to calculate the amount of composition needed to bring the bath up to working strength and then add the solid catalyst. The neglibible volume of the solid catalyst, compared to a liquid concentrate, has little, if any effect on the volume of solution in the catalyst tank. Moreover, it is obvious that shipping and storage of a dry material would be more economical than for a liquid concentrate; and the fact that acid solutions are not involved reduces the safety hazards in handling the catalyst.

There are some practical limitations on how concentrated one can make known catalyst solutions without running into crystallization and stability problems. The maximum concentration normal in commercial use is about four pounds of stannous chloride and 20g of palladium chloride per gallon of solution. A solid catalyst, of the type described herein, can be made substantially of only stannous chloride and the catalytic palladium chloride-stannous chloride reaction product, leading to much more concentrated and stable compositions.

In the present invention, catalytically active compositions are prepared by reacting a palladium salt dissolved in an aqueous halide solution with a molten tin salt, or a solution thereof, in an aqueous nonacid solution. A principal advantage is that no acid is used with either palladium salt or the tin salt solutions. While the reactants may be considered acids, the compositions are free from extrinsic sources of acid, such as hydrochloric or sulfuric acids, which the prior art indicates are absolutely necessary in the preparation of palladium-tin catalyst systems. Halide ions, particularly the chloride and bromide ions, from any compatible water soluble salt, are used to prepare the palladium salt solution, most commonly in the form of the chloride. It is pointed out in Ser. No. 591,363 that halide salt solutions readily dissolve most palladium salts. The tin solution may also contain a compatible halide and any amount of water up to that which causes precipitation of the tin salt. Typical solutions of the tin component include pure molten $SnCl_2.2H_2O$; mixtures of anhydrous stannous chloride and molten stannous chloride dihydrate; mixtures of either containing a compatible halide salt; and water, if desired, under the limitations mentioned above. No acid is needed in this process.

The resulting catalytically active product may be either a liquid or a solid depending on the process conditions used during the manufacture thereof. However, for reasons of stability and ease of handling, it is preferred that a substantially solid product be produced. These catalysts are effective initiators of electroless nickel, copper, and other conventional electrodes plating solutions. They may be used on any suitable non-conductive substrate requiring sensitization, such as acrylonitrile-butadiene-styrene graft polymer (ABS), polypropylene, poly(phenyleneoxide) based resins, epoxies etc.

DETAILED DESCRIPTION OF THE INVENTION

In order to best understand the principles of the present invention, the following examples are set forth which are intended to be illustrative only

EXAMPLE I

In this example, and in others where the electroless metal coverage was tested, standard test plaques were sequenced through a preplate cycle which included the following steps: (1) preliminary etching of the plaque in a chromic-sulfuric acid etch bath, (2) rinsing in water, (3) neutralizing any remaining acid upon the surface (4) sensitizing in the catalytic solutions as described above, (5) acceleration of the sensitizer, and (6) immersion in an electroless nickel bath which contained a source of nickel cations, a hypophosphite reducer, and various stabilizing and buffering compositions. A more detailed description of the preferred concentrations and immersion times is found in "Preplate Systems" by John Robertson, *Products Finishing,* Vol. 37, No. 4 (January 1973).

A mixture of 25.2 gms. of stannous chloride dihydrate ($SnCl_2.2H_2O$) and 2.51 gms. of potassium chloride (KCl) was melted and maintained at approximately 85° C, which is above the melting point of the salt mixture. A solution containing 3.36 gms. of KCl and 2.0 gms. palladium chloride ($PdCl_2$) in 17.79 gms. of water was added to the molten salt mixture. The resulting mixture was maintained at 85° C for 1 hour with constant stirring. At this point 106.19 gms. of $SnCl_2$ (anhydrous) was added and the solution heated at 85° C for an additional hour. The dark brown solution was allowed to cool to room temperature yielding a friable, dry product having a brownish-black appearance.

Upon completion of the first step described above, an excess of water was present. If the solution was allowed to cool to room temperature, the product would be a liquid and the components would tend to crystalize. Consequently, anhydrous stannous chloride is added in the second stage to react with the excess water to yield stannous chloride dihydrte which is a solid at room temperature. An excess of stannous chloride above that which is needed to react with excess water is actually added in order to get an even drier product. The solid component has an actual water deficit of about 10%, being a mixture of about 90% $SnCl_2.2H_2O$ and 10% anhydrous $SnCl_2$(along with the other components).

To 1 liter of a 3N solution of HCl was added 18g of the solid catalyst described above. The solution was stirred until all the catalyst dissolved and the working bath became a dark brownish-red. An etched and neutralized standard ABS plaque (Borg-Warner EPB-3570) was immersed in the catalyst for 3 minutes. The plaque was then accelerated with dilute HCl and placed in a room temperature, electroless nickel bath (Borg-Warner N-35) for 6 minutes. The ABS plaque had 100% nickel coverage, showing that the catalyst had excellent activity.

EXAMPLE II

Stannous chloride dihydrate (25.2g) was melted and stabilized at 80° C. To this was added a solution of 2.0g $PdCl_2$ and 1.68g KCl in 8.09g $H_2O$. The solution was stirred at 80° C for an additional 15 minutes. Then 42.47g $SnCl_2$ was added and the mixture held at 80° C for an additional 15 minutes. The molten mixture was allowed to cool to a hard, dry solid. This catalyst contained essentially all the stannous chloride as $SnCl_2.2H_2O$.

A working bath was prepared by dissolving 18g of the catalyst in 1 liter of 3N HCl. A panel molded from ABS resin (Borg-Warner EPB-3570) was processed as detailed in Example I, including immersion in this working bath for 5 minutes. Electroless nickel coverage was excellent.

EXAMPLE III

A mixture of 6.45g $H_2O$, 0.84g KCl, and 33.87g $SnCl_2$ was heated to 90° C until a homogenous solution resulted. Now a solution of 2.42g KCl and 2.0g $PdCl_2$ in 13.75g $H_2O$ was added and the solution stirred at 90° for 30 minutes. Anhydrous stannous chloride (72.20g) was added and the solution stirred for 30 minutes at 90° C.

Upon cooling, the product was a hard, dry solid. A solution was made up containing 15g of the solid in 1 liter of a mixture of 3N $H_2SO_4$ and 3N Na Cl. Excellent results were obtained when an ABS panel was processed in it for 5 minutes.

EXAMPLE IV

A mixture of 50.4 g $SnCl_2 2H_2O$ and 3.35g KCl, was melted and held at 60° C. It was then mixed with a solution of 2.0g $PdCl_2$ and 1.68g KCl dissolved in 8.09g $H_2O$. After stirring for 2 hours at 60° C. 63.71g $SnCl_2$ was added. The reaction was stirred for an additional 1 hour at 60° C.

The product upon cooling was a dry, friable solid containing approximately 80% of the stannous chloride as $SnCl_2.2H_2O$ and 20% as $SnCl_2$. A working bath was prepared using 20g of the catalyst in 1 liter of 4N HCl. Coverage was excellent for ABS, poly(phenyleneoxide), and polypropylene.

EXAMPLE V

A mixture of 20.16g $SnCl_2.2H_2O$ and 10.05g KCl was heated to 95° C. A solution of 2.0g $PdCl_2$ and 3.36g KCl in 29.12g $H_2O$ was added and the mixture allowed to react with stirring at 95° C for 30 minutes. Anhydrous stannous chloride (152.9g) was added and the solution stirred for an additional 30 minutes at 95° C.

The product, which upon cooling was semi-liquid and non-homogeneous was reheated to 60° C to get a homogenous mass. A portion (24g) of the catalyst was removed and added to 1 liter of 4N HCl. This catalyst gave excellent results with both ABS (EPB-3570) and polypropylene.

EXAMPLE VI

The procedure of Example V was repeated except for the amount of water used. Specifically, 35.59g $H_2O$ was used to prepare the $PdCl_2$/KCl solution instead of 29.12g $H_2O$. This gave a product containing 20% more than the amount of water needed to form stoichiometric $SnCl_2.2H_2O$. The resultant semi-solid was reheated to remove a homogenous sample and a working bath prepared as described in Example V. Plating coverage on both ABS (EPB-3570) and polypropylene was excellent.

EXAMPLE VII

To a beaker containing 25.2g $SnCl_2.2H_2O$, 3.2g NaCl was added and mixed together thoroughly. The mixture was heated to 85° C to melt the $SnCl_2.2H_2O$. Next, an aqueous solution containing 2.0g $PdCl_2$, 1.31g NaCl and 17.79g $H_2O$ was added to the mixture and maintained at 85° C for 1 hour to complete the reaction. Anhydrous stannous chloride (106.18g) was added and the reaction continued for an additional hour at 85° C. A working bath is prepared by dissolving 7.5g of catalyst in 500 ml. of 4N HCl.

EXAMPLE VIII

Example VII was repeated except that in the salt mixture, 5.72 gms. $MgCl_2.6H_2O$ replaced the NaCl, and the aqueous solution added to the salt mixture contained 2.0g $PdCl_2$, 2.28g $MgCl_2.6H_2O$ and 13.55g $H_2O$.

EXAMPLE IX

Example VII was repeated except that in the salt mixture, 6.93 gms. of $LaCl_3.7H_2O$ replaced the NaCl, and the aqueous solution added to the salt mixture contained 2.0g $PdCl_2$, 2.77g $LaCl_3.7H_2O$ and 14.5g $H_2O$.

EXAMPLE X

Example VII was repeated except that in the salt mixture, 5.56 gms. of $MnCl_2.4H_2O$ replaced the NaCl, and the aqueous solution added to the salt mixture contained 2.0g $PdCl_2$, 2.22g $MnCl_2.4H_2O$ and 14.96g $H_2O$.

EXAMPLE XI

Example VII was repeated except that in the salt mixture, 5.78 gms. NaBr replaced in the NaCl, and the aqueous solution added to the salt mixture contained 2.0g $PdCl_2$, 2.3g NaBr and 17.79g $H_2O$.

The catalysts prepared in Examples VII through XI gave excellent plating coverage on ABS.

EXAMPLE XII

Example I was repeated except that in the initial step, a dry mixture of KCl and $SnCl_2.2H_2O$ was added to the hot aqueous solution of KCl and $PdCl_2$. A working bath prepared with 18g in 1 liter of 3N HCl gave excellent plating coverage on ABS.

EXAMPLE XIII

A catalyst reaction was run as described in Example IV, except that after heating two hours at 60° C, 19.44g anhydrous sodium acetate was added instead of 63.71g $SnCl_2$. The mixture was stirred for 30 minutes at 60° C and allowed to cool. The final product was a hard, dry solid containing 20% less water than theoretically needed to produce all $SnCl_2.2H_2O$ and $NaC_2H_3O_2.3H_2O$. A 12g sample was dissolved in 1 liter of 4N HCl. The catalyst gave excellent coverage with ABS.

This example illustrates another method of obtaining a dry catalyst. It is not necessary that all the excess water be tied up merely as $SnCl_2.2H_2O$. Any compatible substance can be added instead of $SnCl_2$ to tie up any excess water and promote maximum stability, shelf life, etc.

From the foregoing examples it can be seen that there are many ways to prepare a plating catalyst without adding acid. The examples have illustrated some of the possible variations in reaction time, temperature, type of halide salt, amount of halide, degree of hydration of product, form of final product, etc. Additional examples would be obvious to those skilled in the art.

What is claimed is:

1. A method of preparing a catalytically active concentrate free from extrinsic sources of acid comprising the steps of:

(1) melting a predetermined quantity of a hydrated stannous chloride composition;

(2) adding an aqueous solution of palladium chloride and a water soluble halide salt, other than said stannous chloride composition and said palladium chloride, selected from the group consisting of bromide and chloride to the molten hydrated stannous chloride;

(3) adding anhydrous stannous chloride to the mixture in a quantity sufficient to convert, at a minimum, all but 20% of the water in said aqueous solution to water of hydration associated with said anhydrous stannous chloride;

(4) reacting the mixture at a temperature between 35° and 140° C; and (5) cooling the product to yield a dry, friable material or a liquid or a semisolid concentrate.

2. The method as defined in claim 1 wherein the initial reactant, hydrated stannous chloride, is formed by dissolving anhydrous stannous chloride in water.

3. The method as defined in claim 1 wherein the reaction time is from 0.05 - 6 hours.

4. The method as defined in claim 1 wherein the molar ratio of halide anion, other than provided by said stannous and palladium salts, to palladium is 2:1 to 40:1.

5. The method as defined in claim 1 wherein the molar ratio of stannous to palladium is from 4:1 to 250:1.

6. The method as defined in claim 1 wherein said halide salt is potassium chloride.

* * * * *